US006776636B1

(12) United States Patent
Cameron et al.

(10) Patent No.: US 6,776,636 B1
(45) Date of Patent: Aug. 17, 2004

(54) PBR WITH TEC BYPASS AND WET DISCONNECT/CONNECT FEATURE

(75) Inventors: David Cameron, Aberdeen (GB); Russell A. Miller, Norwich (GB); Robert C. Smith, Aberdeen (GB); Walter Myron, Ellon (GB); John L. Baugh, Houston, TX (US); Rustom K. Mody, Bellaire, TX (US); Robert J. Coon, Missouri City, TX (US); Michael A. Carmody, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 343 days.

(21) Appl. No.: 09/707,168

(22) Filed: Nov. 6, 2000

Related U.S. Application Data

(60) Provisional application No. 60/163,575, filed on Nov. 5, 1999.

(51) Int. Cl.[7] ..... H01R 4/60
(52) U.S. Cl. ..... 439/191; 439/426
(58) Field of Search ..... 439/190–194, 439/426, 425, 894; 166/65.1

(56) References Cited

U.S. PATENT DOCUMENTS

| | | | | |
|---|---|---|---|---|
| 3,753,206 A | | 8/1973 | Busuttil et al. | |
| 4,117,287 A | * | 9/1978 | Walker et al. | |
| 4,445,734 A | * | 5/1984 | Cunningham | |
| 4,537,457 A | * | 8/1985 | Davis, Jr. et al. | |
| 4,557,538 A | * | 12/1985 | Chevalier | |
| 4,589,717 A | | 5/1986 | Pottier et al. | 339/94 |
| 4,624,309 A | * | 11/1986 | Schnatzmeyer | 166/66 |
| 4,723,924 A | * | 2/1988 | Morrison | 439/875 |
| 4,767,349 A | | 8/1988 | Pottier et al. | 439/191 |
| 4,806,114 A | | 2/1989 | Hopper | |
| 4,921,438 A | | 5/1990 | Godfrey et al. | |
| 5,007,852 A | * | 4/1991 | Dean et al. | 439/101 |
| 5,141,051 A | | 8/1992 | Lenhart | |
| 5,389,003 A | | 2/1995 | Van Steenwyk et al. | 439/191 |
| 5,927,402 A | | 7/1999 | Benson et al. | 166/65.1 |
| 5,967,816 A | | 10/1999 | Sampa et al. | 439/190 |

FOREIGN PATENT DOCUMENTS

EP 0 860 907 A2 8/1998

* cited by examiner

*Primary Examiner*—Neil Abrams
(74) *Attorney, Agent, or Firm*—Cantor Colburn LLP

(57) ABSTRACT

A wet connect/disconnect arrangement is disclosed for a downhole system that allows installation of various tools and/or a string and subsequent electrical connection to the downhole system in a wet environment. Several embodiments are disclosed, all of which produce a clean, reliable connection. Exemplary embodiments include an upper section being mechanically and electrically joined to an intermediate section with electrical connectors for being joined at a lower section. The intermediate section further has auxiliary connectors that may be protected by a cover and remain unmated in a first connected application being therefore available for future use. The upper section may be removed leaving the intermediate section in place whereby the unmated connectors are available to rejoin a new upper section. Different types of connectors are also disclosed.

34 Claims, 15 Drawing Sheets

PBR WITH TEC BYPASS AND WET DISCONNECT/CONNECT FEATURE

CROSS-REFERENCE TO RELATED APPLICATIONS

This application claims the benefit of U.S. Provisional Application Serial No. 60/163,575 filed Nov. 5, 1999, which is incorporated herein by reference.

BACKGROUND OF THE INVENTION

1. Field of the Invention

The invention relates to downhole electrical connections made up in a wet environment. More particularly, the invention relates to downhole sealed connectors which self-clean upon makeup to avoid contamination in the connection.

2. Prior Art

Downhole power/signal wire connection/disconnection has always been a problem for the industry. More specifically, because the downhole environment is extremely hostile to electric connection (salt water, fresh water, acids, etc.), it has traditionally been thought that a reliable "wet connection" could not be effected. Prior art systems have attempted to create wet connection that employ in the downhole environment but have met with only limited reliability. The prior art connectors are quite small and require an unlikely degree of precision when the connection is to be made, for example, 5000 feet below the surface. Therefore, although these connectors are reasonably capable of providing a good electrical connection at the surface in modern wellbore systems, they fail to solve the need for connection of an uphole string to a downhole string far below the surface. Such connections are required for the plurality of tools incorporated which require power and instructions.

SUMMARY OF THE INVENTION

The above-discussed and other drawbacks and deficiencies of the prior art are overcome or alleviated by the wet connector/disconnector embodiments of the invention.

All of the embodiments of the invention avoid the need to stab-in a small connector. The stabbing-in of the tubing itself is all that is necessary to make up the connection. This is a substantial benefit to the art in view of the growing use of electrically activated dowahole tools. The wet connect/disconnect ensures reliability of such systems due to an increase in the likelihood of connection and a reduction in the care needed to effect the connection.

Most of the embodiments disclosed herein employ an insulator that protects a conductor installed with the downhole equipment. The insulator may be rubber, plastic, metal, a grease, etc. with the joining principal being to maintain the conductor in a very clean condition. Additionally, some of the embodiments further include a hydraulic fluid wash to ensure the conductor does not become contaminated when the insulator is pierced or otherwise removed by the string/connector being stabbed in. Generally, the conductor on the stab-in tool is also protected by one or more of the insulators noted above.

Other embodiments do not employ conductor insulators on the downhole string but rely upon a cleansing action of the uphole string upon stab-in to remove any debris or oxidation that may have accumulated on the downhole conductors.

With each of the embodiments disclosed herein, the process of stabbing in causes certain events to occur which lead to secure reliable connections.

In addition to the ability to wet connect, some of the embodiments herein allow for a wet disconnect and reconnect which is advantageous for situations requiring such activity. In one embodiment, a portion of the uphole string is left connected to the downhole string. This leaves the connection made during stabbing-in undisturbed. Rather a piece of the uphole section, which itself provides a new insulated conductor (or not insulated) for a subsequent stab-in procedure, is left behind. Thus, in the event that the uphole section of string needs to be pulled, a reconnection may be made at a later time in the same manner as the original conductor mating. In order to be able to leave a section downhole, a switch section must also be employed to break the connection with the upper string. The switch section must break the connection in a sealed environment to prevent a short circuit upon reconnecting the uphole string.

BRIEF DESCRIPTION OF THE DRAWINGS

Referring now to the drawings wherein like elements are numbered alike in the several FIGURES.

DETAILED DESCRIPTION OF SEVERAL PREFERRED EMBODIMENTS

Figure 1:
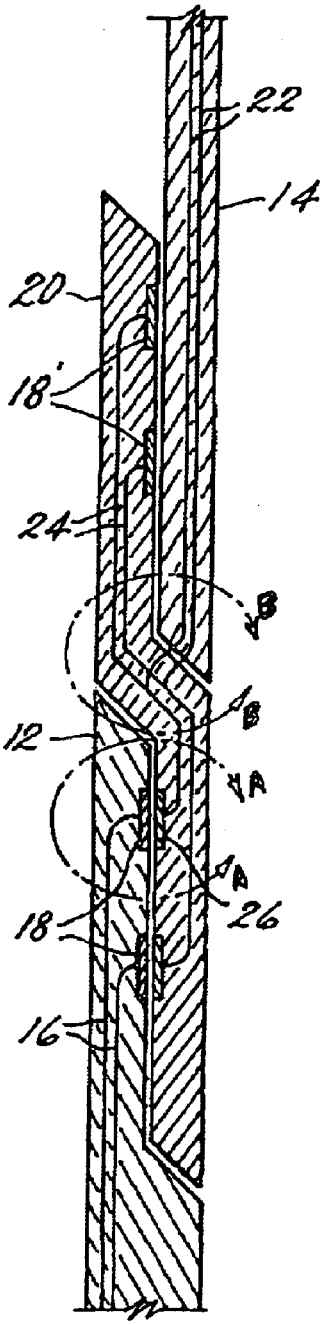
FIG. 1 is a schematic elevation view of the concept of the invention.

Referring to FIG. 1, a schematic illustration provides an understanding of the disclosure in its broadest sense without details on the specific mechanisms of operable models. It will be understood that many different embodiments are possible which are capable of being employed to effect the desired results aforesaid. Each of the FIGURES following FIG. 1 illustrate small sections of FIG. 1 to teach one of skill in the art a way of connecting or disconnecting the circumscribed areas A or B of FIG. 1. It is also to be appreciated that in many instances in this specification reference is made to "electrical" or "electrically"; this terminology is for exemplary purposes only and it is intended that the reader understand that other conductors such as fiber optic conductors and light could also be employed.

The broad concept begins with the manufacture of a connection device capable of being installed in a wellbore in various ways and connected to various other devices. FIG. 1 illustrates schematically, a connection device in a wellbore. In FIG. 1, a lower (first) section of wellbore has been completed with (or from the stand point of manufacture is completable with) a tool string 12 having one or more electrically actuated or controlled tools which may have sensors, etc. This lower section 12 is for any number of reasons, which are known to those of skill in the art, isolated from an upper (second) section of tubing string 14. For this reason, providing an electrical connection between the upper section 14 and lower section 12 is needed. As noted above, such connections have been difficult in the prior art because of the harsh downhole environment. This disclosure therefore, provides a system for such connection by excluding the downhole fluids from the section 12 conductors (or cleaning them) and ensuring that contaminants do not become introduced thereto during connection. Lower section 12 includes associated wires (or fibers) 16 (one or more) which are connected at the factory to conductor pads (connector) 18. Conductor pads 18 are generally embedded in the tubing and will include a seal thereover to prevent contamination. Lower section 12 is run in the hole or otherwise disposed downhole in this condition and will remain in a sealed condition with respect to the pads 18 until an upper section 14 is run in the hole to make a connection with pads 18. Exactly how the pads are connected is discussed hereunder.

It will be appreciated in the FIG. 1 illustration that another distinct part is illustrated between lower section 12 and upper section 14. This is reconnect (third) section 20. Reconnect section 20 is optional to operability of the system with respect to the original connection. It should be appreciated from a review of FIG. 1 that the features of lower section 12 are duplicated in reconnect section 20. Thus, it will be understood that upper section 14 might only contain features sufficient to mate with lower section 12 and avoid reconnect section 20. In a preferred embodiment, however, reconnect section 20 is included. Section 20 provides features that substitute for the second connector with respect to connection to the first connector. The section allows for the original connection to remain intact if the upper section 14 is pulled for some reason. This prevents contamination of the conductor pads 18. By way of explanation, once the conductor pads 18 are freed from the insulation that protects them (in this type of embodiment) by the action of stabbing in the uphole section, they are left unprotected from the elements. With the upper section attached, no environmental fluid can contact the pads. If the upper section is pulled however, the conductors would be subject to attack by wellbore fluids. Reconnecting to these conductor pads would be unlikely to succeed. For this reason reconnect section 20 is employed. Continuing now with the discussion of section 20, the section includes a disconnect for the wires in the upper section 14 so that the termination of electrical continuity caused by the pulling of section 14 does not allow a "live" connection to contact downhole fluids. This is important to prevent damage to downhole electrical tools or destruction of the system upon reconnect. The disconnection area is schematically illustrated by circumscribed area B in FIG. 1.

Reconnect section 20 is solely provided to create a stacked system capability. More specifically, reconnect section 20 is connected at the factory to the upper section 14 with a shearable or otherwise releasable connection to upper section 14. In the event upper section 14 must be removed from the hole, it leaves in its wake, reconnect section 20 which includes new sealed connector pads 18' and wires 24 which connect to the original stab in connectors 26. A subsequent upper section may then be stabbed into the reconnect section with the same reliability as the original connection the concept of the reconnect section may be employed over and over again as many times as a disconnect and reconnect are necessary. The reconnect sections simply continue to stack up as strings are pulled and reconnected.

Turning now to specific mechanisms, circumscribed area A is discussed first and is directed to several embodiments for creating a clean electrical connection with reliability and high confidence. In these FIGURES, only the connection mechanism is illustrated. It is to be understood that the mechanism is part of section 14 or section 20 as desired. Following the discussion of area A, circumscribed area B is discussed. Area B is directed to embodiments for breaking the connection with the wires 22 of section 14 when that section is pulled.

Figure 2:
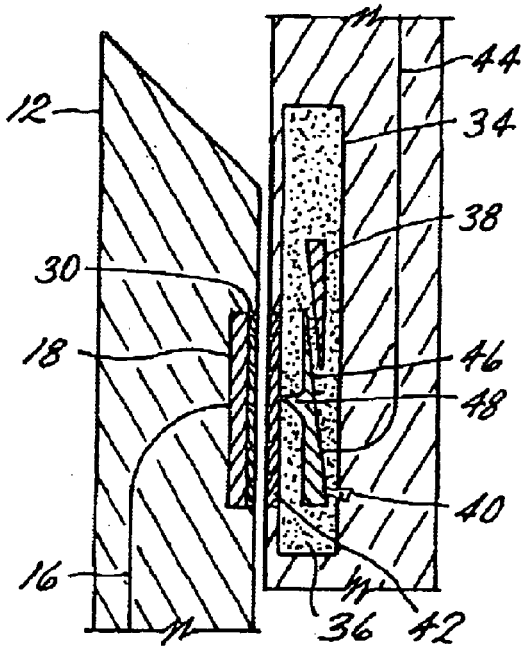
FIG. 2 is an enlarged view of a specific embodiment for circumscribed portion A of FIG. 1.

Referring to FIG. 2, a cover 30 illustrated herein as plastic, but which may be rubber or metallic, is positioned in a sealed relationship over conductor 18. Thus, while this portion of lower section 12 is exposed to wellbore fluid, the conductor 18 is protected. The connection mechanism which is shown in place after run in but before actuation, includes a bore 34, preferably filled with hydraulic fluid 30 (or similar). A wedge 38 is provided in the bore 34 which is driven like a piston preferably by pressure from a proximate or remote source into contact with electrical connector 40 connected with wire 44 from the upper section. Electrical connector 40 includes a ramped surface 46 and a punch 48. Ramped surface 46 is complementary to wedge 38 and connector 40 is urged thereby toward seal material 42. Continued urging of connector 40 results in piercing of seal 42. Upon the piercing of seal 42, fluid 36 escapes from bore 34, flooding the area between seal 42 and seal 30. The flooding action displaces wellbore fluids and provides a clean dielectric embodiment in which the connection can be made. Continued urging of connector 40 causes the punch 48 to pierce seal 30 and come into electrical contact with conductor pad 18. It should be noted that fluid 36 may preferably be dielectric fluid or a dielectric grease. The grease is preferred due to its viscosity and therefore its tendency to remain around the connection.

Figure 3:
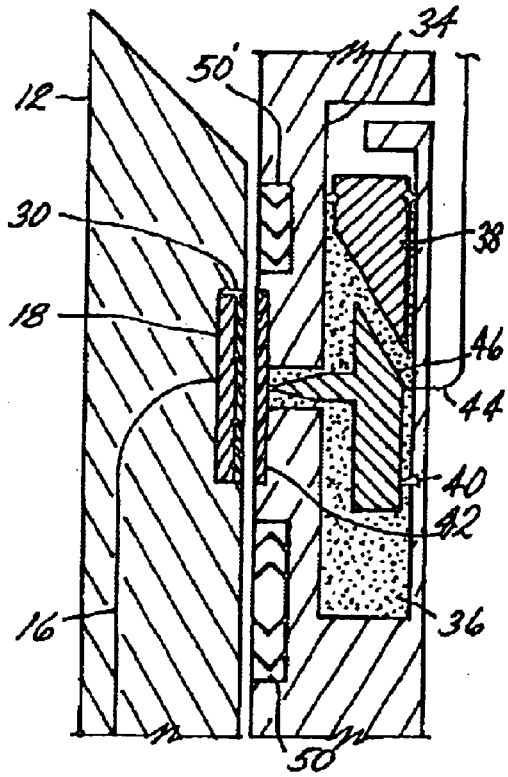
FIG. 3 is an enlarged view of an alternate specific embodiment for circumscribed portion A.

Referring now to FIG. 3, an alternate connection mechanism is illustrated. This mechanism, it will be appreciated, is very similar to the embodiment of FIG. 2 and merely adds seals 50 which are preferably chevron type seals. For clarity, the other parts of this embodiment, though slightly different in some respects are numbered identically to FIG. 2. The FIG. 3 embodiment provides additional, if redundant, assurance of the continued cleanliness of the connection area. Seals 50 do not allow fluid to pass in either direction whereas seal 50' allows fluid to pass in only the "out" direction relative to the space defined by seals 50, 50'. Thus, the movement of the cleansing fluid 36, which in this embodiment is preferably hydraulic fluid, will sweep all remnants of well fluids out of the connection space and provide a clean connection area.

Referring to FIGS. 4A, 4B and 5A, 5B another alternate embodiment of the invention is illustrated. Because of the relative complexity of the embodiment, it is illustrated in both a nonconnected and connected form, FIGS. 4A, 4B and 5A, 5B, respectively.

Figure 4A:
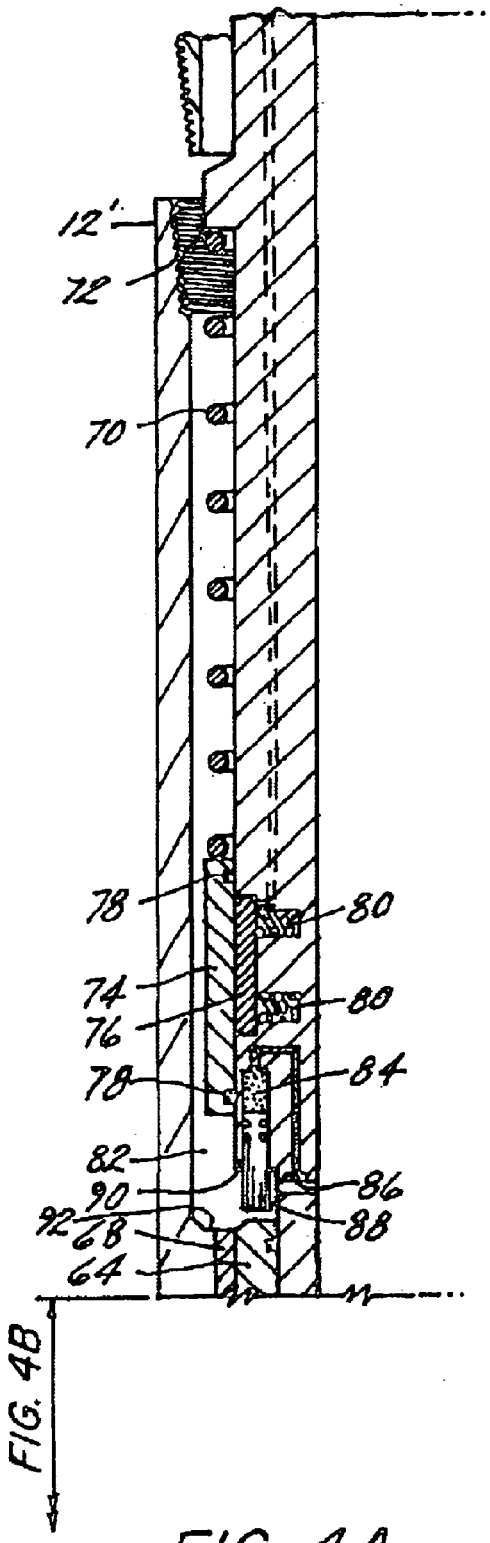
FIGS. 4A and 4B are a top and bottom portion of an alternate connection apparatus for the circumscribed portion A in FIG. 1 in a non-connected position.
Figure 4B:
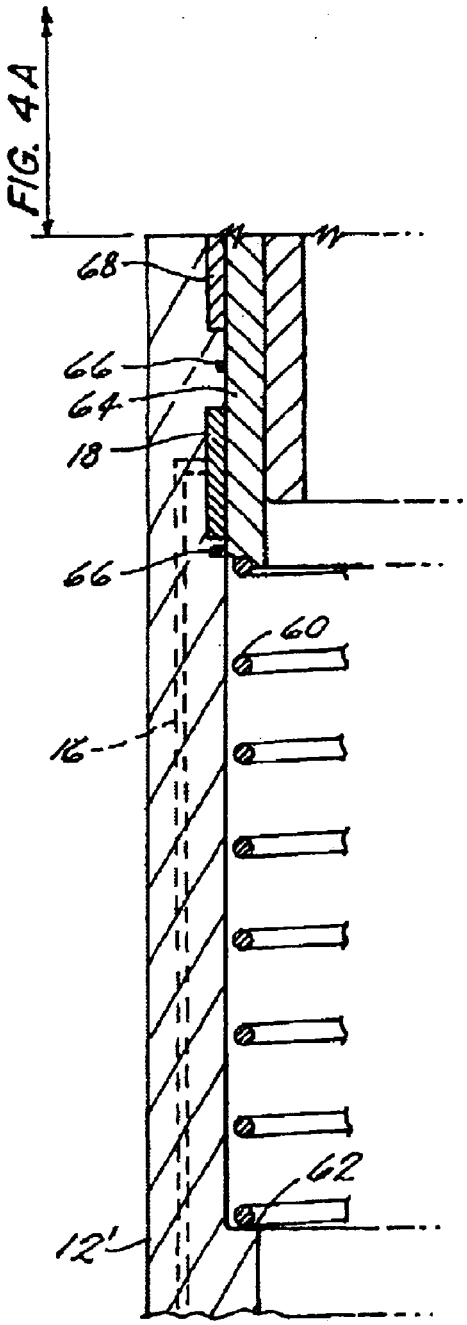

Referring first to FIGS. 4A and 4B, lower section 12 will provide a reference. This embodiment functions by sliding the upper section, or reconnect section if so equipped, relative to the lower section 12' against spring biased rings which cover the conductor pads. Lower section 12 of this embodiment includes spring 60 based upon land 62 which biases ring 64 to a position where it covers pad 18. Section 12' also includes preferably two o-rings 66, which seal against ring 64, and a wiper 68. Section 14', or 20' if so equipped, includes spring 70 which rests on spring stop 72 and biases ring 74 to a position covering conductor pad 76. Ring 74 is sealed over conductor pad 76 by o-rings 78 mounted in ring 74. Conductor pad 76 is preferably spring loaded by springs 80 so that it will be biased against conductor pad 18 when so positioned.

An astute reader, skilled in the art, will recognize that there is a volume 82 that likely is contaminated, and that this volume might be problematic to the connection even in view of wiper 68. To eliminate this possibility, the inventors hereof have provided an enclosed hydraulic fluid reservoir 84 which opens via a rupture disk 86 to volume 82. A piston 88 is provided which is operably connected to reservoir 84 and positioned such that the "sliding past" of this embodiment as discussed above causes piston 88 to move into reservoir 84 increasing pressure therein until rupture disk 86 fails and hydraulic fluid is expelled into volume 82. The hydraulic fluid will displace any wellbore fluids in the volume 82 and render the area clean.

In operation, piston 88 lands on ring 64 and expels the hydraulic fluid as discussed. Once piston 88 is fully depressed into the bore of reservoir 84, shoulder 90 begins to urge ring 64 downhole by over coming the bias of spring 60. Next, ring 74 comes into contact with shoulder 92 of section 12' and is urged uphole by overcoming the spring 72 with downhole movement of the upper section or the reconnect section as the case may be.

Conductor pad 76 is uncovered at the time it reaches wiper 68 and is wiped clean to remove any oxidation that may have developed over time. Continued downhole movement of the uphole section aligns conductor pads 18 and 76 and the connection is complete.

Figure 5A:
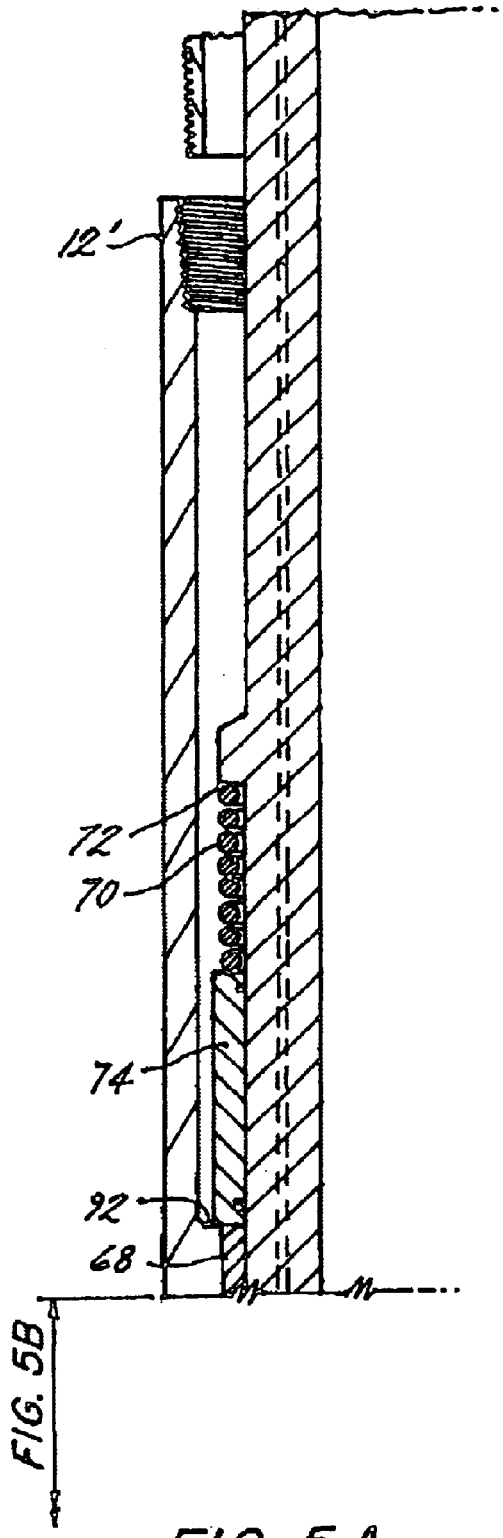
FIGS. 5A and 5B are a top and bottom portion of the embodiment of FIGS. 4A and 4B in a connected position.
Figure 5B:
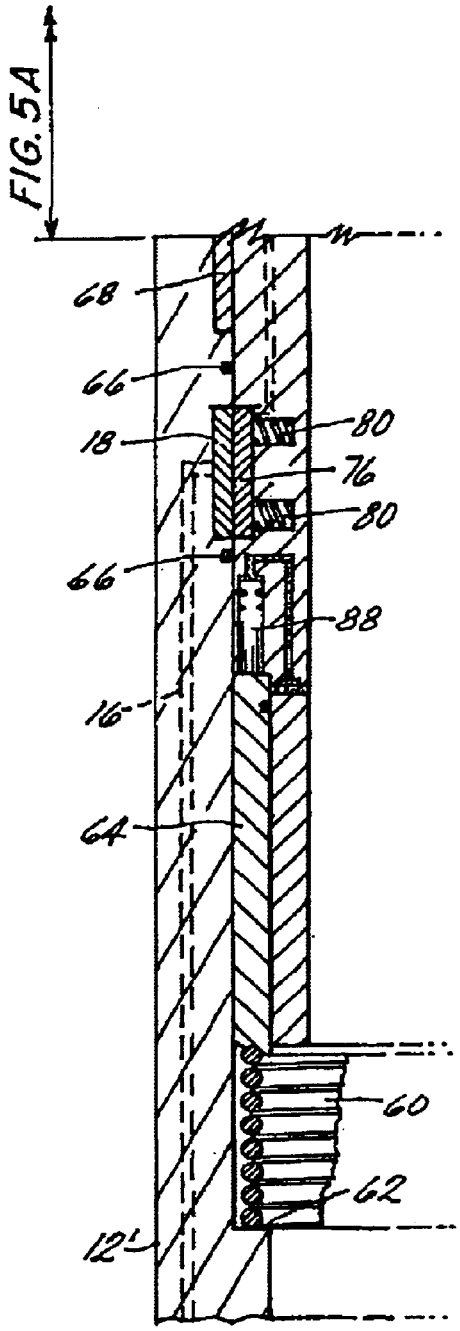

FIGS. 5A and 5B illustrate this embodiment in the connected condition to promote understanding of the invention.

Figure 6A:
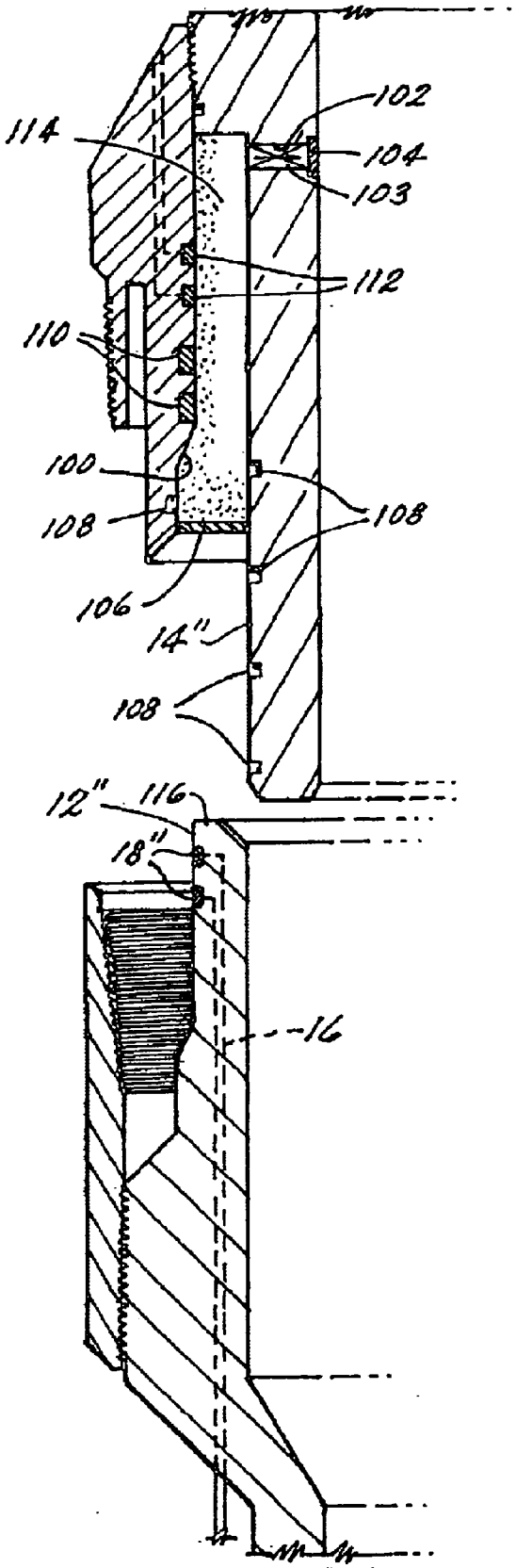
FIGS. 6A and 6B are disconnected and connected views, respectively of another alternate embodiment for the circumscribed section A in FIG. 1.
Figure 6B:
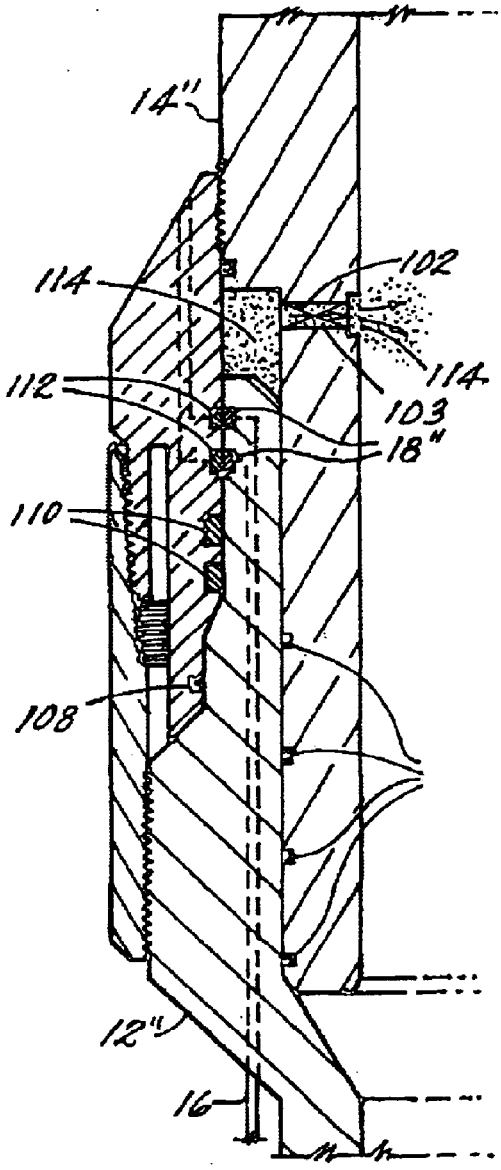

Referring now to FIGS. 6A and 6B, yet another alternative mechanism for the circumscribed area A in FIG. 1 is illustrated. The lower section of the drawing is an alternative configuration of section 12 and thus is identified as 12". The conductive pads also differ in appearance and thus are designated 18". The upper section 14" (it should be understood that the upper section of the FIGURE could also be the reconnect section) includes a fluid-filled chamber 100 having an exhaust port 102 sealed by a one-way valve 103 and a rupture disk 104. The chamber 100 is sealed at its other end by seal 106. In a preferred arrangement several o-ring seals are also supplied and are identified by 108. Focusing on the portion of upper section 14" that defines chamber 100, it will be noted that two wipers 110 are provided. One wiper would be effective but two is preferred for redundancy and better cleaning. Contact pads 112 are provided in this area and are protected by fluid 114 in chamber 100.

In use, nose 116 of section 12" is urged into seal 106 ultimately rupturing the seal. since o-rings 108 will prevent fluid 114 from escaping around nose 116, the fluid instead becomes pressurized. As the pressure in chamber 100 increases, burst disk 104 ruptures and fluid 114 is conveyed through the valve 103 to the tubing I.D. Since valve 103 will not permit fluid to pass in the other direction, the connection area in the chamber 100 will remain clean. Continued movement of nose 116 into chamber 100 brings pads 18" into wiping contact with wipers 110 where the conductor pads 18" are cleaned of any oxides that have formed thereon. The pads 18" then align with pads 112 and the connection is made as illustrated in FIG. 6B.

Figure 7:
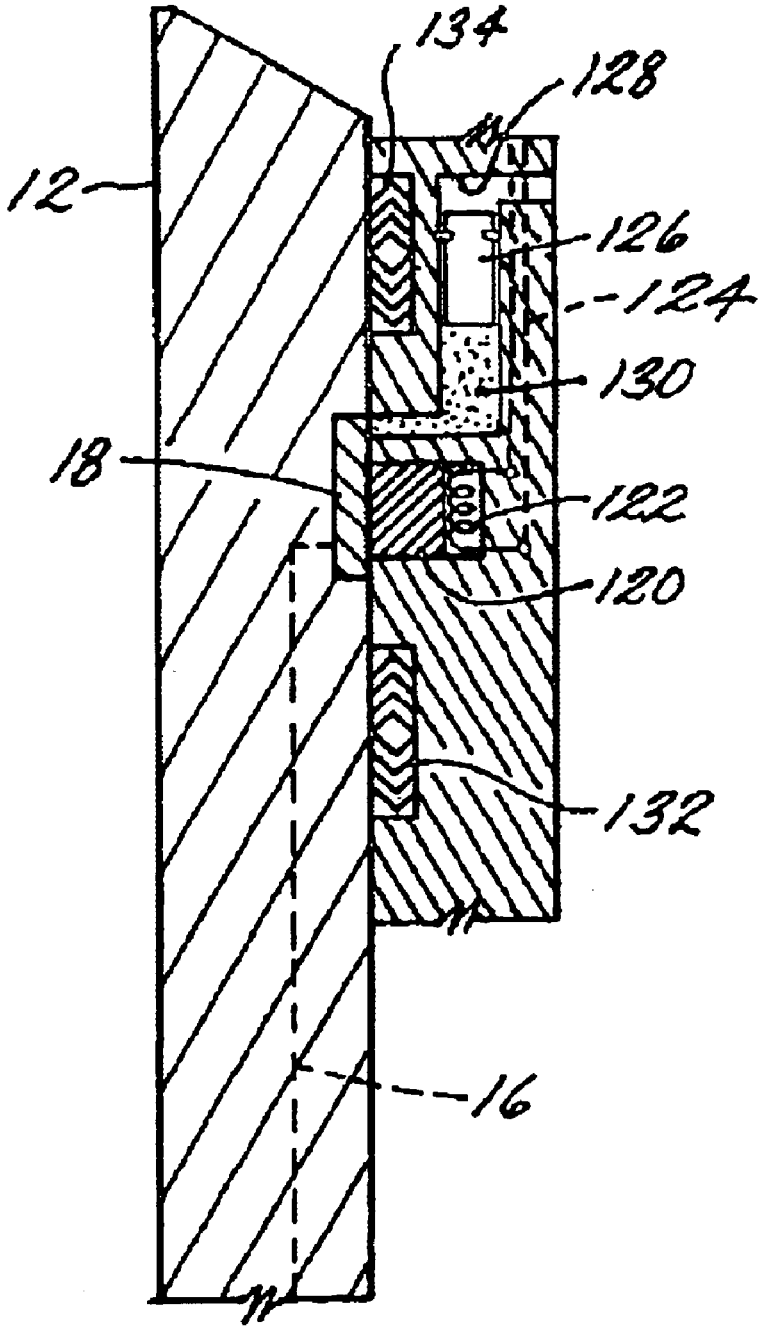
FIG. 7 is another alternate embodiment for the circumscribed section A in FIG. 1.

FIG. 7 is another alternative embodiment relating to circumscribed area A is illustrated. In this embodiment the upper section provides a connector 120 which is composed of a low temperature melt metal (obviously, melting temperature must be above well temperature at projected depth). The metal connector 120 is positioned adjacent conductor pad 18 and includes a coil 122 proximate thereto, the proximity being sufficient to melt the connector 120. As in previous embodiments, seats 134, 132 are provided and a reservoir 128 includes fluid 130 actuated by a piston 126 to flush the contact area. In this embodiment a surface actuated current or a downhole actuated current melt the connector 120 which then flows into electrical contact with conductor pad 18.

Figure 8A:
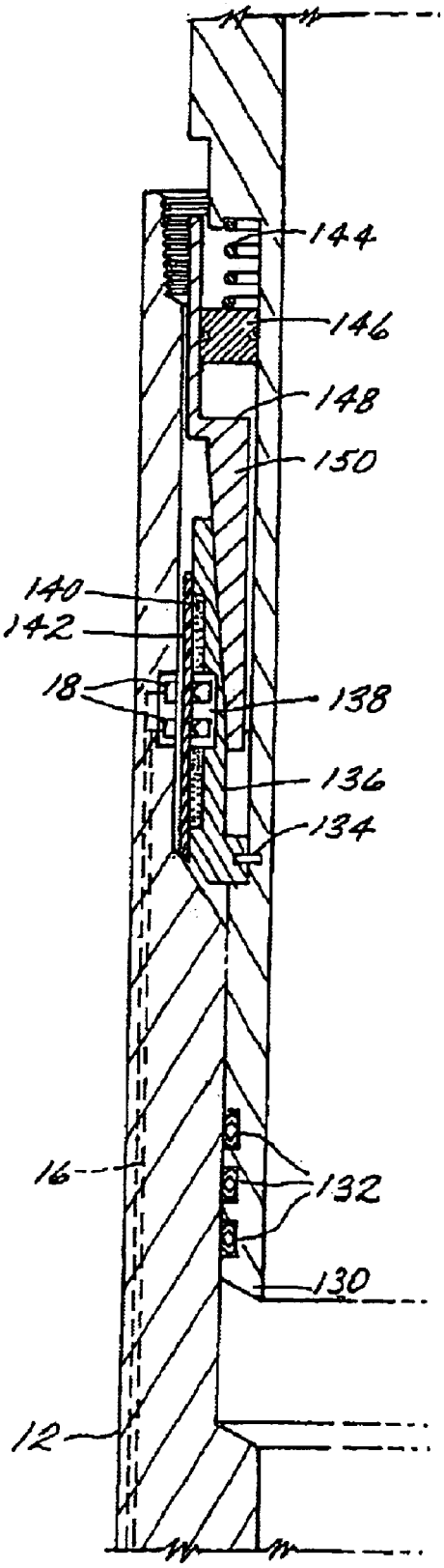
FIGS. 8A and 8B are disconnected and connected views respectively of another alternate embodiment for the circumscribed section A in FIG. 1.
Figure 8B:
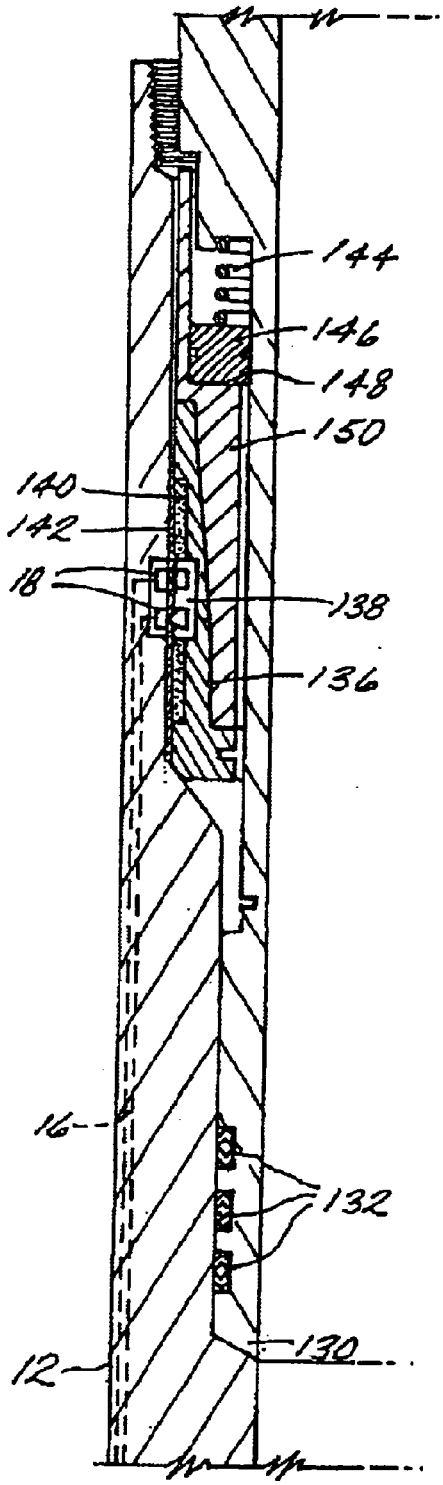

In another alternate embodiment for circumscribed Section A, referring to FIGS. 8A and 8B lower section 12 includes two conductor pads 18. The upper section of the drawing which again can be the equivalent of section 14 or section 20 in FIG. 1 depending upon whether a reconnect option after a pull-out is to be provided, provides a nose 130 with several seals 132 of preferably the chevron type. Attached to nose 130 by a release mechanism, preferably a shear pin 134, is connector wedge 136 which houses a piercing conductor pad 138 in fluid 140 under seal 142. Upon downward movement of the upper section of the drawing (14 or 20) a spring 144 is urged against a ring 146 to move the same downhole until it contacts landing 148 of counter wedge 150. Further downward movement causes counter wedge 150 to move downhole behind connector wedge 136 to cause conductor pads 138 to pierce cover 142 and come into contact with conductor pads 18 to complete the circuit.

As discussed above, in the event upper section 14 is removed from the hole, the connections must be broken to prevent a short circuit. This is, for illustrative purposes, at the area marked B on FIG. 1. It is important to note that just stretching the connectors to break leaves them exposed to wellbore fluids and invites short circuit. Therefore the inventors hereof have provided the following two embodiments of disconnects. It is to be understood, however, that other mechanisms for providing such a disconnect are clearly within the scope of the invention.

Figure 9A:
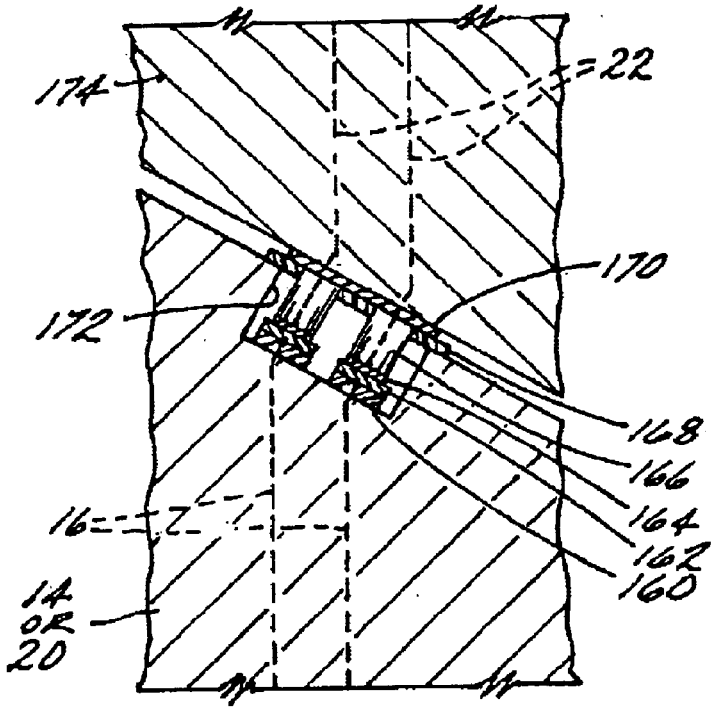
FIGS. 9A and 9B are an embodiment of the circumscribed area B in FIG. 1.
Figure 9B:
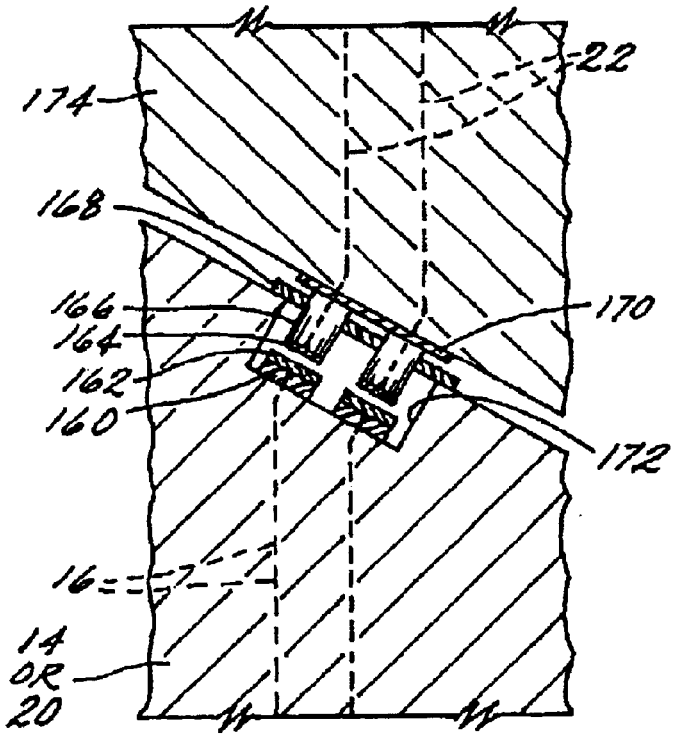

Turning now to FIGS. 9A and 9B, the first disconnect embodiment is illustrated in the connected position and the disconnected position. The disconnect itself comprises a connector pad 162 disposed a top an insulator 160 in a recess 172 in section 12. The recess 172 is sealed by cover 168 which may be of a plurality of distinct materials so long as they either deflect or allow a sealed sliding of the pins 166 therethrough. In the case of deflection, the pins 166 need not slide through cover 168 (the non-sliding arrangement being illustrated herein).

As one can readily ascertain from the drawings, pins 166 provide a base for pads 164, the pins extending to outside cover 168 and into connection with plate 170. The disconnect is connected together in the factory and appears as illustrated in FIG. 9A. When a disconnect is desired, pulling the tool causes the switch to be in the condition illustrated in FIG. 9B wherein the electrical connection is broken and the ends of the downhole wires are protected within recess 172 and cover 168. It will be apparent to one of skill in the art that if upper portion 174 of the drawings is to be removed altogether the disconnect will have to shear at a point above the cover 168. Alternatively, the portion 174 could simply be a ring which remains downhole.

Figure 10A:
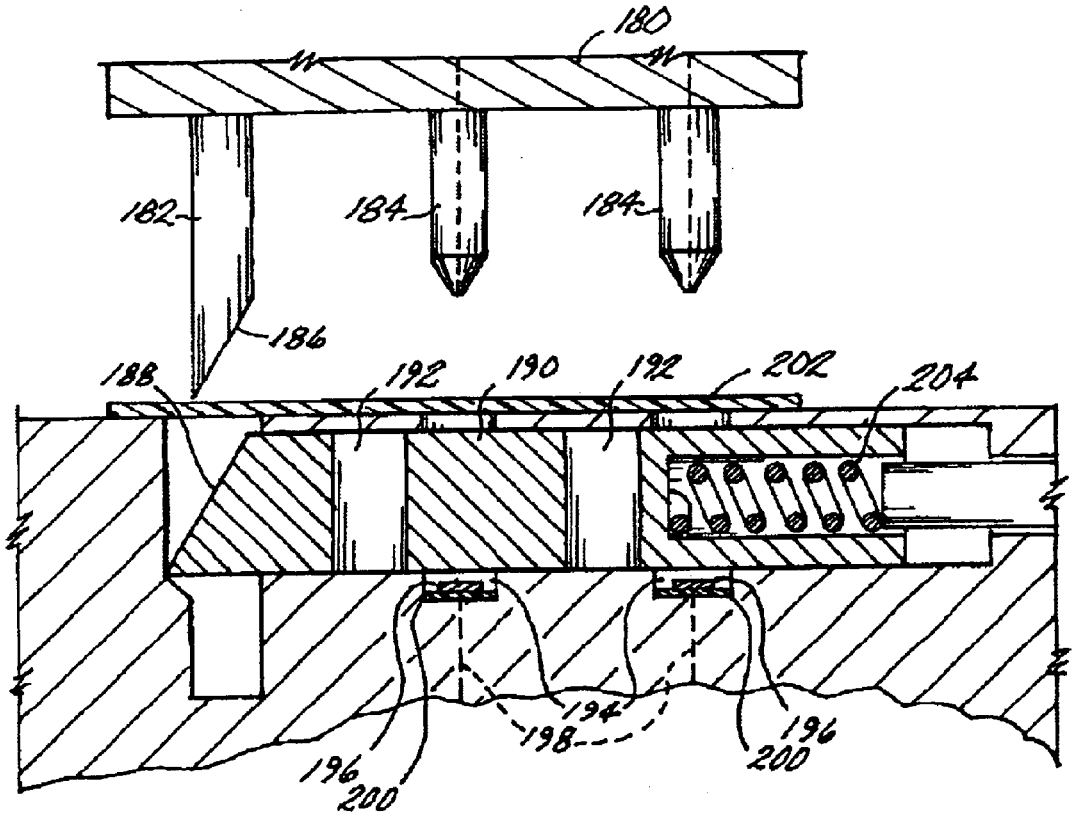
FIGS. 10A–C are various positions of an alternate embodiment of the circumscribed section B in FIG. 1.
Figure 10B:
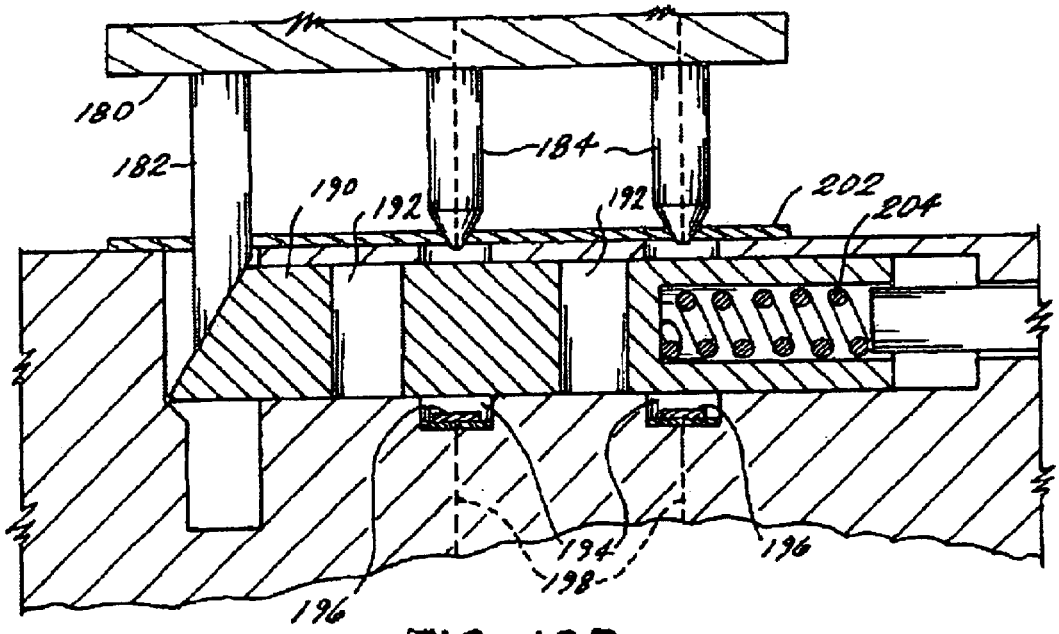
Figure 10C:
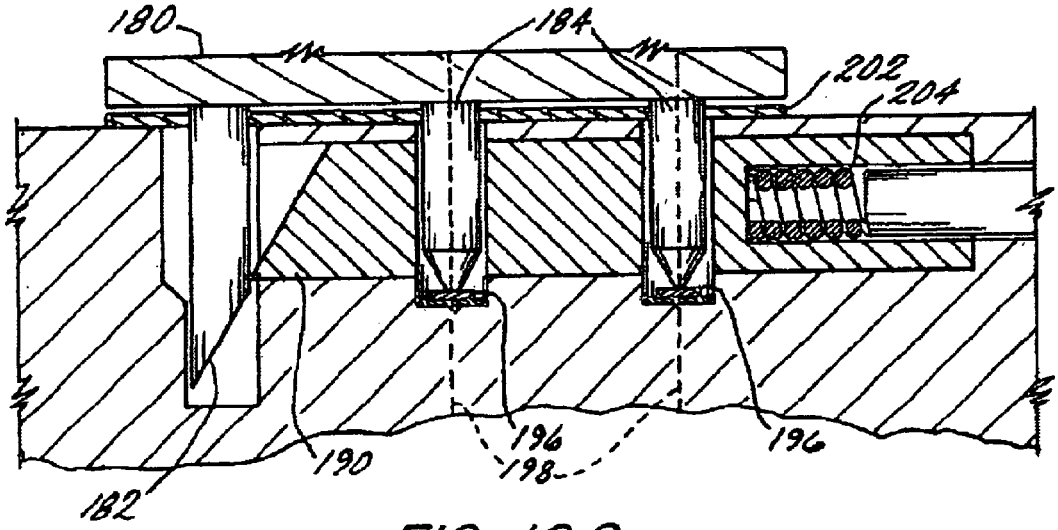

Referring now to FIGS. 10A, 10B and 10C a second disconnect embodiment is illustrated. This disconnect is intended to work in much the same way that the embodiment of FIGS. 9A 9B works and thus only the distinctions are discussed here. Contact bar 180 is connected to an uphole piece of the pipe and supports actuator pin 182 and contact pins 184. Pin 182 includes a wedge 186 which is angled sufficiently to actuate slide 190 through slide pitch 188. Actuation of slide 190 moves it (to the right in the drawing) to align ports 192 with contact receptacles 194 wherein contact pads 196 are disposed and connected to wires 198. Once alignment as described is complete, pins 184 may come into electrical contact with pads 196 (pads 196 are insulated from the metallic tool by insulation 200).

The length of the pins 182 and 184, is important to the operation of the invention. Upon disconnecting, it is required that the slide 190 be closed (under bias of spring 204) prior to pins 184 pulling free from membrane 202. By so requiring, the breach in the seal of membrane 202 due to the pins 184 being extended therethrough is not able to allow contamination into receptacles 194. Obviously it is intended that slide 190 make sealing contact with the surrounding area. This embodiment is made up in the factory preferably but is also useable in the field because of the ability of pin 182 to actuate slide 190 in a time frame where the pins 184 will protectively be in membrane 202.

Figure 11:
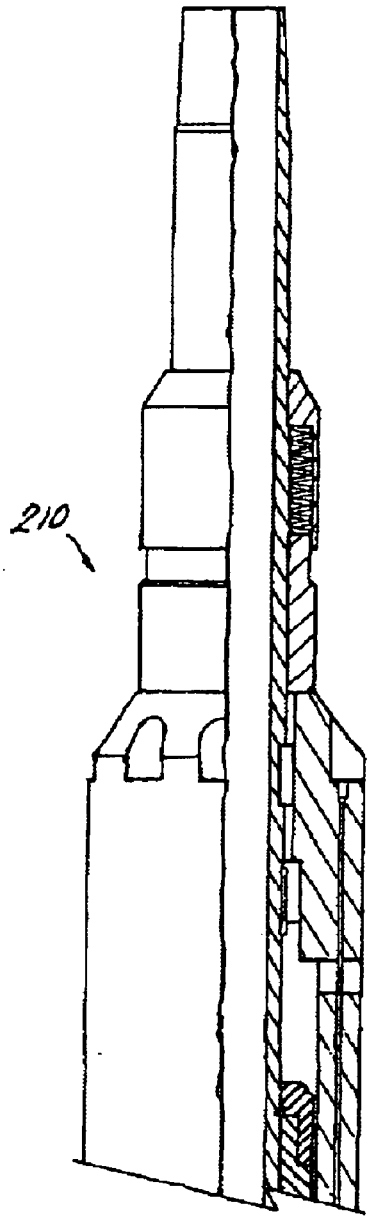
FIGS. 11–13 are an elongated quarter-section view of the tool of this embodiment of the invention to illustrate the disassembled condition.
Figure 12:
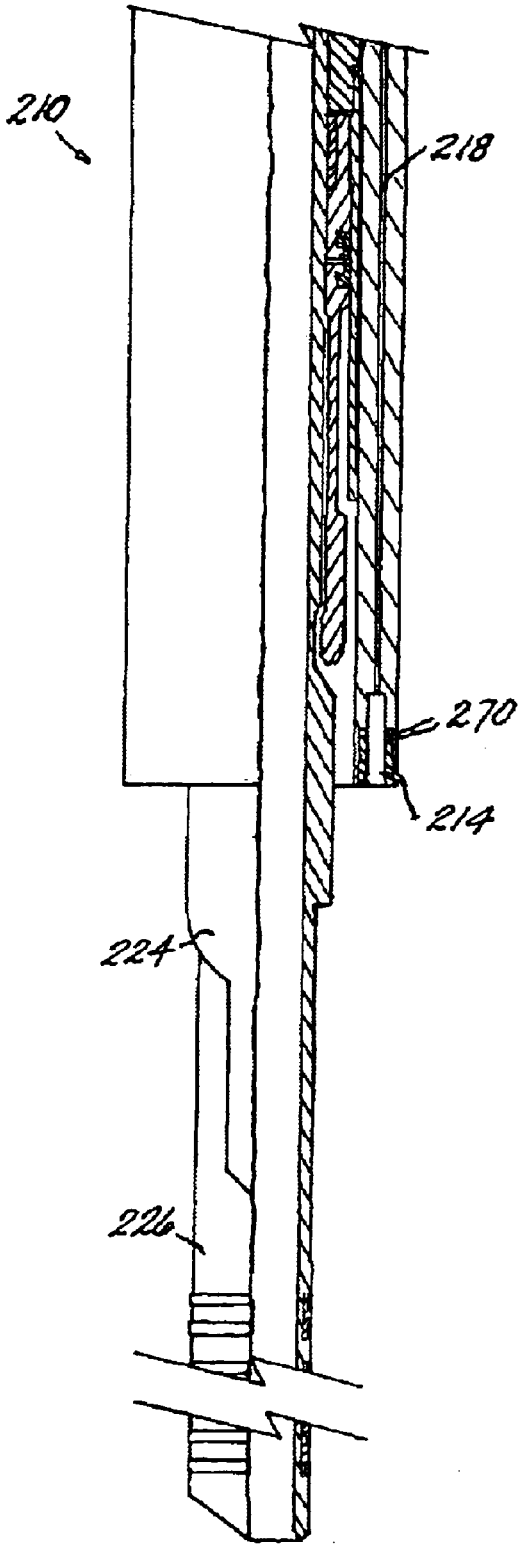
Figure 13:
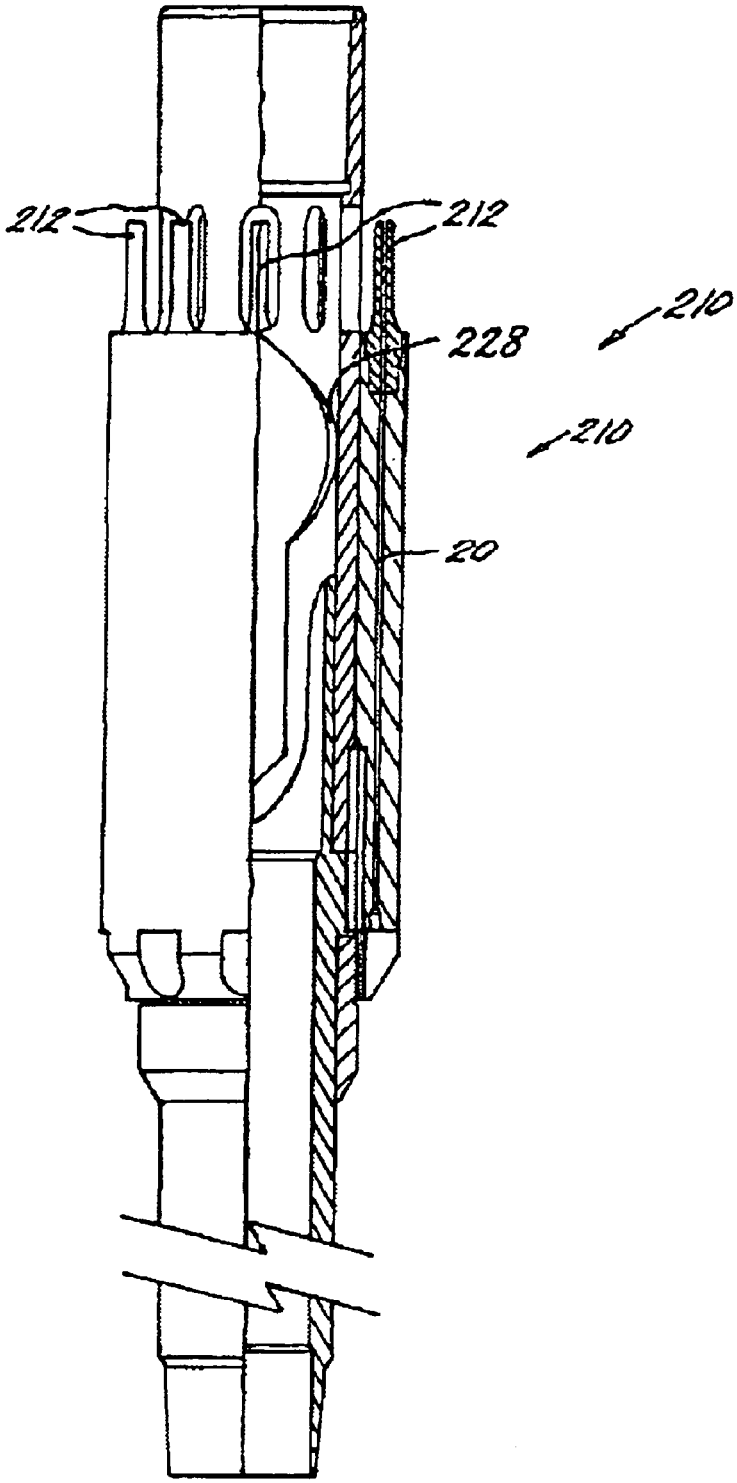
Figure 14:
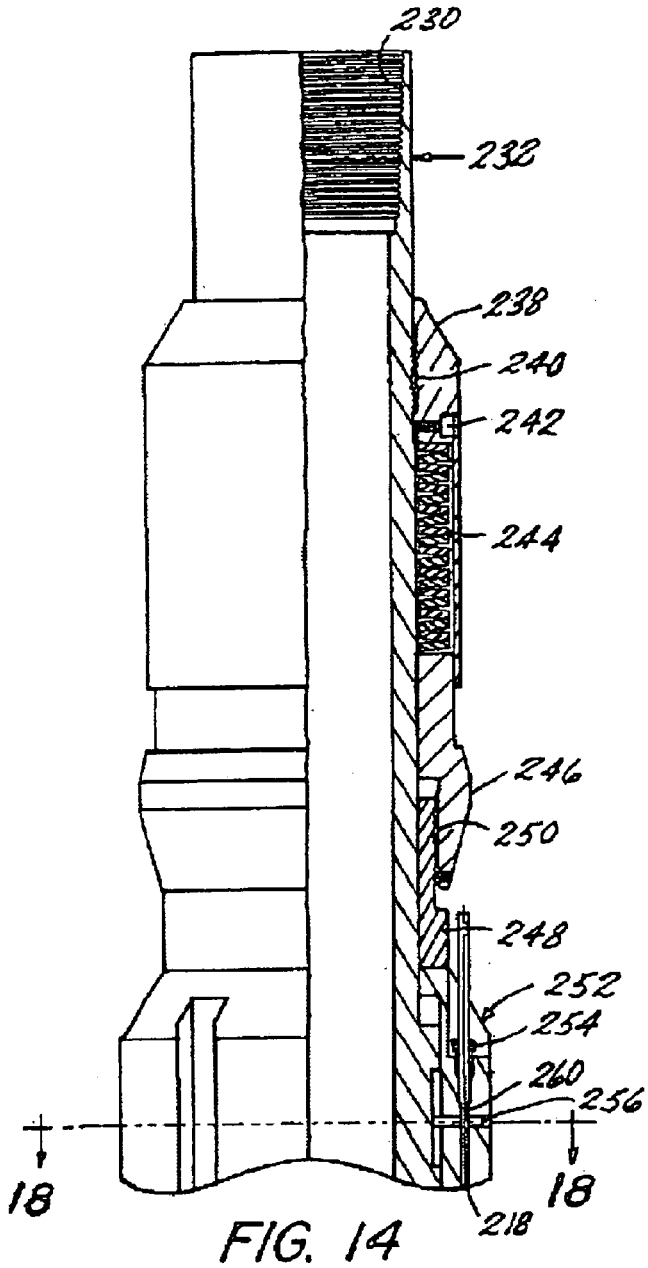
FIGS. 14–17 are together an elongated quarter-section view of another connector tool of the invention.
Figure 18:
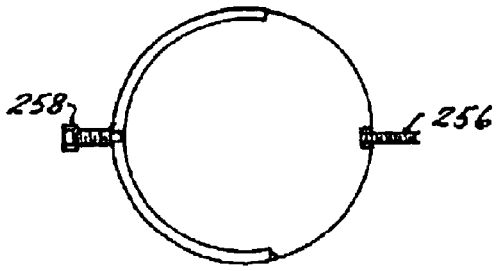
FIG. 18 is a cross section view of the portion of the invention illustrated in FIG. 11 taken along section line 15—15.

In yet another embodiment of the invention wherein conductors are aligned and connected. Referring initially to FIGS. 11–13 a more schematic view of the invention is illustrated. The view does not contain all of the parts of the invention and thus is intended to convey the locations and orientation of the connectors. Tool 10 breaks down to a top half (comprising FIGS. 11 and 12) and a bottom half comprising FIG. 13. When the halves are separated as illustrated in FIGS. 11–13, lower seal adapters 212 (twelve of them on the embodiment shown although more or fewer could be employed) are visible on bottom half (FIG. 13) and the complementary upper seal adapters 214 (an equal number to the number of lower seal adapters 212). Upper seal adapters 214 preferably include a pair of o-rings 270 to fluid tightly seal the lower seal adapters. Upper seal adapters 214 are connected to the uphole environment via conduits 218 while at the other end of the connection, lower seal adapters 12 are connected to the downhole environment via conduit 20. The conduits 218 and 220 preferably contain fiber optic conductors. The mating ends of the conductors are cleaned by preferably a hydraulic fluid which may be applied in a number of ways including adaptations of the embodiments preferably does not include threads between the alignment profile and end connections.

Although the top and bottom portions of the tool are run in the hole together (assembled at the surface), an alignment profile 222 is provided in the tool to align the top and bottom halves in the event that they are separated. Therefore, referring directly to FIGS. 12 and 13, a profile 224 is a raised area in a predetermined orientation on the anchor sub 226. The profile 224 mates with a complementary profile 228 in bottom half (FIG. 13). The orientation profiles ensure that the lower seal adapters 212 will align and mate with upper seal adapters 214 reliably.

Turning now to the internal components of this embodiment of the invention, referring to FIGS. 14–19, and beginning at the uphole end of the tool, a box thread 230 is provided to attach the tool to a work string (not shown). The box thread 230 is cut in body 232 which extends downhole to threadedly mate with anchor sub 234 at thread 236. Body 232 supports, near the uphole end thereof, disc spring retainer cap 238 which is threaded to the O.D. of body 232 at thread 240. Cap 238 is further preferably anchored by cap screw 242. Cap 238 functions to retain preferably a plurality of disc springs (belleville washers) 244. Springs 244 absorb longitudinal movement of upper and lower seal adapters. Moreover, the washers keep the upper and lower seal adaptors positively shouldered internally which is important for pump down, replaceable optic fiber installation and other installations. Disc springs 244 are maintained in position at the downhole end by retainer sub 246. Sub 246 is annular and is threaded to disc spring adjustment sub 248 at thread 250.

Figure 15:
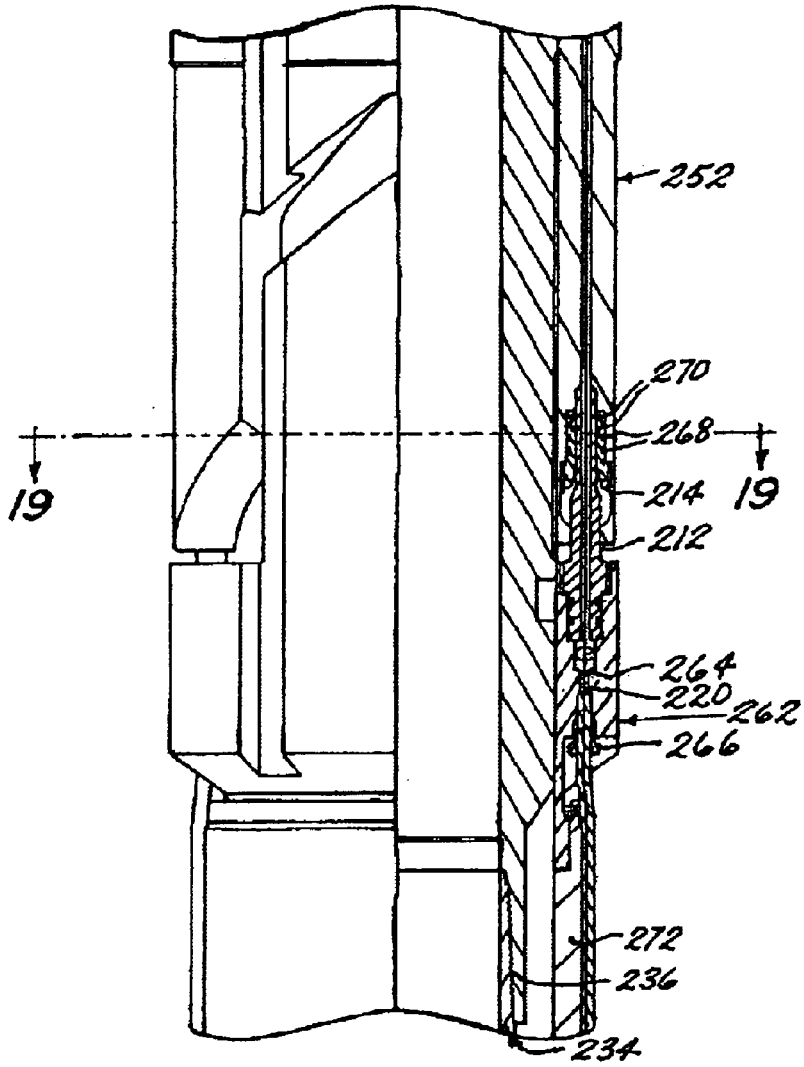
Figure 19:
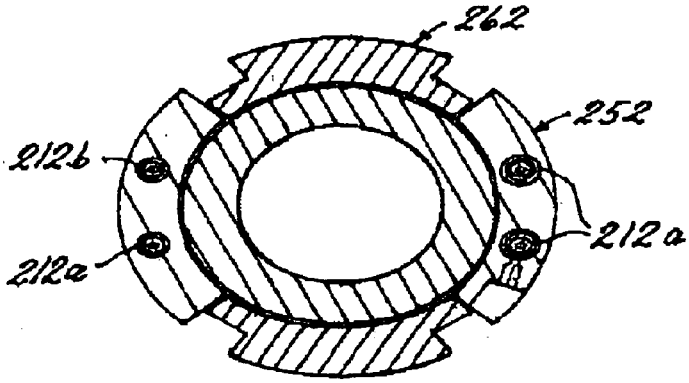
FIG. 19 is a cross section view of the portion of the invention illustrated in FIG. 12 taken along section line 16—16.

Downhole of attachment sub 248 and radially outwardly of body 232 is upper connector 252. Upper connector 252 houses upper seal adapters 214 at the downhole end thereof and a line connector assembly 254 which preferably comprises a pair of ferrules and a jam nut (not individually shown). The connector 252 is retained in position on body 232 by shear screw 256 and shoulder screw 258. These latter screws are best viewed in FIG. 18. A plurality of bores 260 are provided in upper connector 252 to receive conduit 218. Lower connector 262 (FIGS. 15 and 19) is disposed downhole of upper connector 252 and houses lower seal adapter 212, bore 264 for conduit 220 and a control line connector 260 which comprises a pair of ferrules and a jam nut (not individually shown). It should be noted that FIG. 15 provides a cross section view of the tool which shows the upper and lower seal adapters that were explained previously herein. It should also be noted that upper seal adapter 214 includes two sets of o-rings 268 and 270. Rings 268 seal upper seal adapter 214 to upper connector 252 while rings 270 seal the lower seal adapter 212 into the upper seal adapter 214 when it is so engaged. Lower adapter 212 may be for conventional conductors or fiber optic conductors. FIG. 19 illustrates three of four (212*a*) in conventional form and one (212*b*) in fiber optic form.

Figure 16:
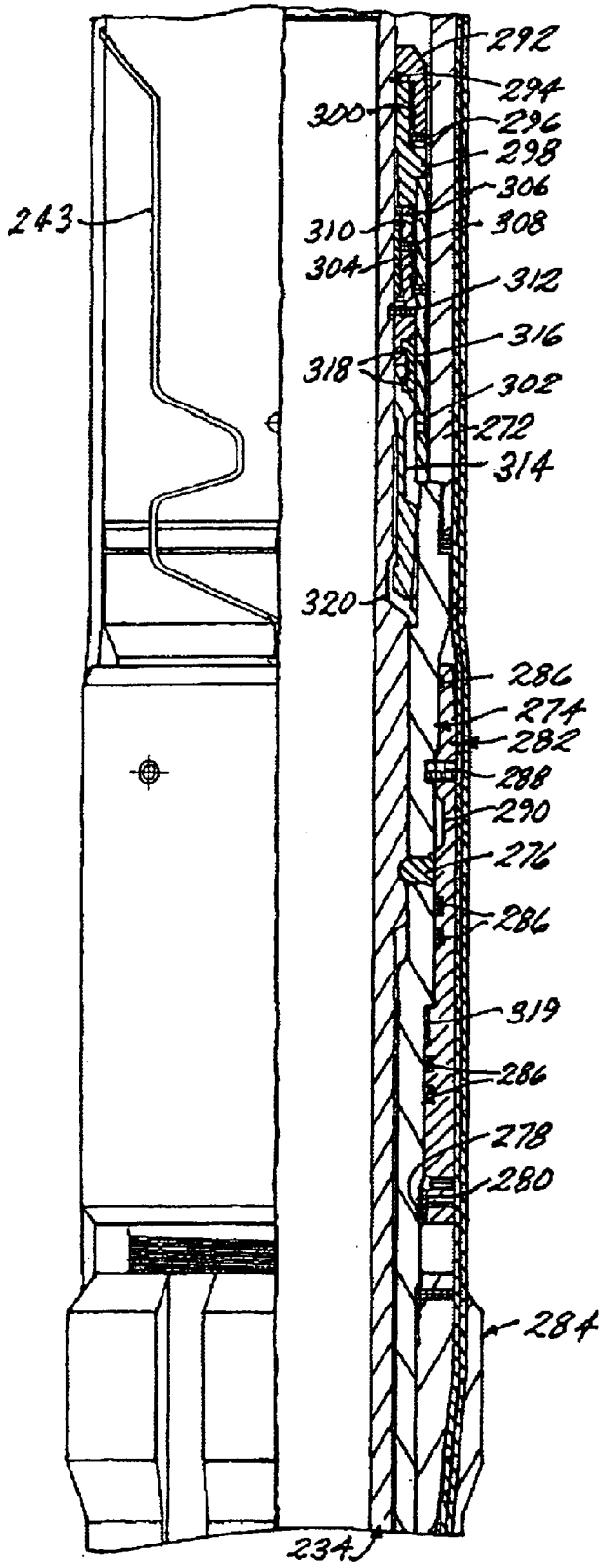
Figure 17:
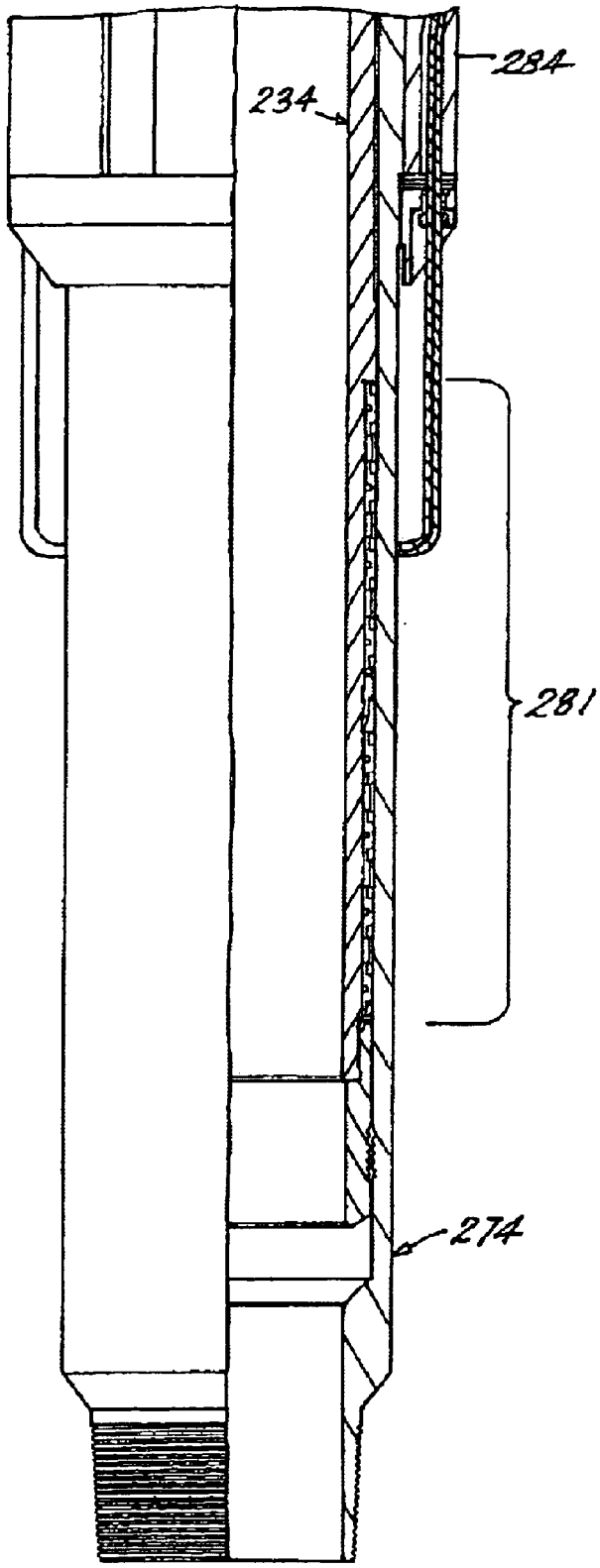

Bridging FIGS. 15 and 16 is sleeve 272 which covers the components of the snap in/snap out feature of the invention (components discussed hereunder). Sleeve 272 is connected to seal housing 274 which includes locking dogs 276. Seal housing is also threaded at 278 for a body lock ring 280. The lock ring 280 is rotationally arrested by roll pin 236. Seal housing 274 is sealed to anchor sub 234 by seal stack 281.

Radially outwardly of seal housing 274 (FIGS. 16 and 17) are housing 282 and control line sub 284. Housing 282 includes several seals 286, several screws 288 and a dog receiving profile 290.

Radially inwardly of sleeve 272 (FIG. 16) is the snap in/snap out assembly mentioned above. The assembly includes, beginning from the uphole end, a shear ring retainer 292 which is connected to the anchor sub 234 by shear ring 294. Shear ring retainer 292 is also connected to support ring 298 through set screws 296 and thread 300. Support ring 298 supports set down sleeve 302 and is in contact with body lock housing 306. Body lock ring housing 306 is connected to body lock ring 304 conventionally and including a set screw 308 to arrest rotational movement. Body lock ring housing 306 is also threadedly connected to set down sleeve 302 by thread 310. Body lock ring housing 306 cannot move up or downhole because of shear screw 312 which engages anchor sub 234. Body lock ring housing 306 is connected to latch 314 by parting ring 316 which is a ring having holding profiles 318 to retain the body lock ring housing 306 to latch 314 until a predetermined tensile load is placed thereon which breaks the parting ring 316.

In operation and after running in the hole, a pressure line 243 (FIG. 16) pressurizes a piston area 318 sealed by seals 86. Upon reaching a predetermined pressure, shear screw 288 shears and allows housing 282 to move downhole thus locating recess 290 over locking dogs 276 allowing them to move radially outwardly to disengage from anchor sub 234. Once anchor sub 234 is disengaged from the dogs 276 it will be free to move. Body lock ring 280 is provided to prevent housing 282 from moving back uphole and reseating the dogs 276. After initial setting then, the housing portion of the tool is permanently moved and the dogs 276 are permanently disengaged from anchor sub 234. Following this disengagement, the tool upper portion (FIGS. 11 and 12) and lower portion (FIG. 13) are separable using the snap in/snap out assembly in order to develop a proper space-out for the particular well, the tool may be snapped in/snapped out as many times as necessary until sufficient weight is committed and the anchor sub 234 supports the latch 314. In this latter condition the snap out feature is disabled.

Once the space out is appropriate, set down weight which exceeds the shear strength of shear ring 294 and shear screw 312 is applied. After shearing, anchor sub 234 moves downhole through lock ring 304 and is retained in this position until retrieval is necessary or desired.

In order to retrieve the tool, a tensile load is placed on the anchor sub which transmits to the body lock ring 304, the parting ring 316 and the latch 314. When a predetermined tensile load is exceeded, the parting ring fails and the anchor sub 34 moves uphole. This unsupports latch 314 allowing the latch to deflect into recess 320 and the snap out sub is operational. Continued tensile load will disengage the upper portion of the tool from the lower portion for retrieval. The process as described can then be repeated with a new or rebuilt upper portion.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A conductor connection device for makeup and break in a wet downhole environment comprising:

a first section connectable to implements intended to be located farther downhole than said first section when said device is installed in a wellbore;

at least one first section conductor associated with said first section;

a first connector in operable communication with each said at least one first section conductor, said first connectors being maintained in a clean condition or being cleanable while in the wet environment by operation of the connection device;

a second section connectable to implements intended to be located farther uphole than any said second section when said second section is installed in a wellbore;

at least one second section conductor associated with said second section;

a third section operably connected to said second section;

at least one third section conductor associated with said third section, said at least one third conductor being operably connected to said at least one second section conductor;

a third connector in operable communication with said at least one third section conductor, said third connector being maintained in a clean condition or being cleanable while in the wet location by operation of the connection device, said third connector being connectable to said first connector by operating said connection device, said third section being optionally separable while in the wet location from said second section after said connection device is operated to break the electrical connection between said implements located farther uphole and said implements located farther downhole;

a forth connector in operable communication with said at least one third conductor, said forth connector being maintained in a clean condition or being cleanable while in the wet location by operation of a subsequent connection device configured to make electrical connection with said fourth connector.

2. A conductor connection device as claimed in claim 1 wherein said third section further comprises a conductor break to prevent conductive contact of said at least one first section conductor through said at least one third section conductor with wellbore fluids upon seperation of said third section from said second section.

3. A conductor connection device as claimed in claim 2 wherein said conductor break comprises at least two contacts maintained in a clean environment, said contacts being seperable upon seperation of said second section.

4. A conductor connection device as claimed in claim 3 wherein said clean environment is maintained by a deflectable cover to which one of said at least two contacts is connected, said deflectable cover being deflected to maintain connection of said at least two contacts while said third section is attached to said second section.

5. A conductor connection device as claimed in claim 2 wherein said conductor break comprises:

at least one contact pin; and at least one contact receptacle.

6. A conductor connection device as claimed in claim 5 wherein said break further comprises a slide which seals said at least one receptacle when said at least one pin is not engaged in said at least one receptacle.

7. A conductor connection device as claimed in claim 6 wherein said break further includes an actuator pin to actuate said slide.

8. A conductor connection device as claimed in claim 1 wherein said first connector and said third connector each comprise:

at least one pad;

at least one fluid impermeable covering on each said at least one pad.

9. A conductor connection device as claimed in claim 8 wherein said connection device further includes at least one interconnector providing interconnection between said first connector pad and said third connector pad.

10. A conductor connection device as claimed in claim 9 wherein said interconnector is a conductive piercing member which pierces said at least one fluid impermeable covering on each said at least one pad upon operation of said connection device.

11. A conductor connection device as claimed in claim 1 wherein said connection device is configured to provide a dielectric material to a vicinity of interconnection between first connector and said third connector.

12. A conductor connection device as claimed in claim 10 wherein said covering is rubber.

13. A conductor connection device as claimed in claim 10 wherein said covering is metal.

14. A conductor connection device as claimed in claim 11 wherein said dielectric material is oil.

15. A conductor connection device as claimed in claim 11 wherein said dielectric material is grease.

16. A conductor connection device as claimed in claim 1 wherein said first connector and said third connector are exposed to environmental conditions and are wiped clean during operation of the connection device.

17. A conductor connection device as claimed in claim 16 wherein said device is configured to provide a dielectric material to an interconnection vicinity of said connection device.

18. A conductor connection device as claimed in claim 17 wherein said dielectric material is oil.

19. A conductor connection device as claimed in claim 17 wherein said dielectric material is grease.

20. A conductor connection device as claimed in claim 17 wherein said dielectric material is dispensed from a reservoir in said device.

21. A conductor connection device as claimed in claim 16 wherein said first connector and said third connector are wiped clean by each other.

22. A conductor connection device as claimed in claim 16 wherein said first connector and said third connector are wiped clean by a wiper.

23. A conductor connection device as claimed in claim 20 wherein said reservoir includes a check valve.

24. A conductor connection device as claimed in claim 1 wherein said first connector is a pad and said third connector includes a meltable conductive element.

25. A conductor connection device as claimed in claim 24 wherein said element is meltable by a coil.

26. A conductor connection device as claimed in claim 25 wherein said coil is powered from within said device.

27. A conductor connection device as claimed in claim 25 wherein said coil is powered from external to said device.

28. A conductor connection device as claimed in claim 1 wherein said device is configured to provide a dielectric material to an area of interconnection of said first connector and said third connector.

29. A conductor connection device as claimed in claim 28 wherein said dielectric material is oil.

30. A conductor connection device as claimed in claim 28 wherein said dielectric material is grease.

31. A method for creating a conductive connection in a wet downhole environment while providing for disconnection and reconnection in the wet environment comprising:

installing a first section connectable to implements located farther downhole than an intended location of said first section, said first section having at least one first section conductor associated therewith and a connector operably connected to said at least one conductor;

installing a second section connectable to implements located farther uphole than an intended location of said second section, said second section having at least one second section conductor associated therewith, said second section further including a third section having at least one third section conductor associated therewith and a third connector operably connected at one end to said at least one third section conductor and a fourth connector operably connected at the other end of said at least one third section conductor; and engaging said third section and said first section creating an electrical connection between said first connector and said third connector while in the wet environment.

32. A method for creating a conductive connection as claimed in claim 31 further including:

disconnecting said second section from said third section; and installing a replacement second section and engaging said third section in position as connected to said first section in the wet downhole environment.

33. A method for creating a conductive connection as claimed in claim 31 wherein said engaging includes flushing with a dielectric fluid, a connection area of interconnection between said first connector and said second connector.

34. A method for creating a conductive connection as claimed in claim 31 wherein said engaging includes flushing with a dielectric fluid, a connection area of interconnection between said first connector and said third connector.

* * * * *